United States Patent [19]

Alekhin et al.

[11] 4,342,222

[45] Aug. 3, 1982

[54] METHOD FOR THE DETERMINATION OF DEPTH OF A FLUID-SATURATED STRATUM AND FLUID TYPE

[76] Inventors: Stanislav A. Alekhin, Chilanzar, Kvartal 24, 53, kv. 89; Vitold M. Bakhir, Gaidara, 7-A, kv. 17; Raisa I. Born, Chilanzar, kvartal 24, 53, kv. 89; Tatyana M. Bakhir, proezd Gaidara, 7-A, kv. 17, all of, Tashkent; Aman I. Khusandzhanov, poselok neftyanikov, Surkhandarinskaya oblast, Kumkurgan-2, all of U.S.S.R.

[21] Appl. No.: 224,552

[22] PCT Filed: Sep. 28, 1979

[86] PCT No.: PCT/SU79/00086

§ 371 Date: Nov. 27, 1980

§ 102(e) Date: Nov. 25, 1980

[87] PCT Pub. No.: WO80/02050

PCT Pub. Date: Oct. 2, 1980

[30] Foreign Application Priority Data

Mar. 27, 1979 [SU] U.S.S.R. ..... 2736512

[51] Int. Cl.[3] ..... E21B 49/00

[52] U.S. Cl. ..... 73/153

[58] Field of Search ..... 73/155, 153; 324/438; 175/40; 23/230 EP

[56] References Cited

U.S. PATENT DOCUMENTS 3,722,606 3/1973 Fertl et al. ..... 73/153 X 3,802,259 4/1974 Eckels ..... 73/153

*Primary Examiner*—Jerry W. Myracle

*Attorney, Agent, or Firm*—McAulay, Fields, Fisher, Goldstein & Nissen

[57] ABSTRACT

A method for the determination of depth of a fluid-saturated stratum and type of a fluid, such as mineralized water, oil and gas released during drilling, comprising pretreating the drilling mud before feeding to a well so as to maintain the original value of its redox potential at a stable level. The supply of the drilling mud to the well is suspended upon a change in the redox potential indicating to the presence in the drilling mud of a fluid saturating the stratum. After a certain time lapse the supply of the drilling mud to the well is renewed. The time of restoration of the drilling mud supply to the well and the time of appearance of the batch of the drilling mud diluted with the fluid saturating the stratum are marked and are used to determine the depth of the stratum. The redox potential of the batch of the drilling mud saturated with the fluid is measured and compared to known normal values of redox potential to determine the type of the fluid.

1 Claim, 1 Drawing Figure

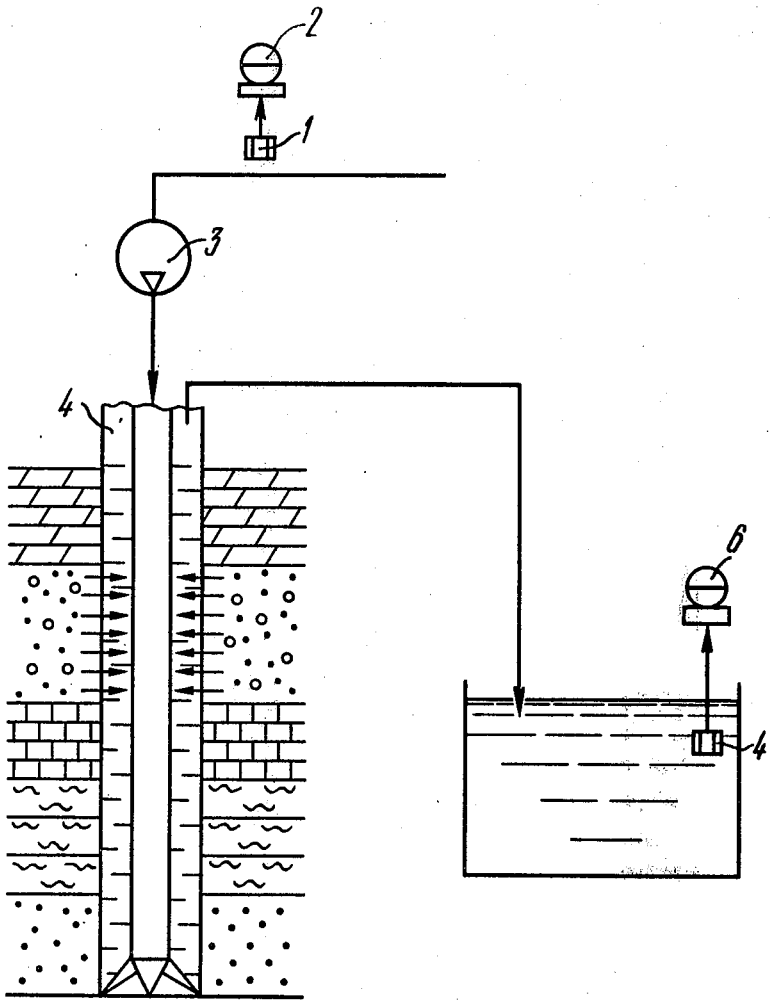
2
1
3
4
6
4

METHOD FOR THE DETERMINATION OF DEPTH OF A FLUID-SATURATED STRATUM AND FLUID TYPE

TECHNICAL FIELD

The present invention relates to the techniques for the study of drilled wells, and more particularly to methods for the determination of depth of a fluid-saturated stratum and fluid type.

The present invention may be most advantageously used in oil and gas recovery industries in drilling wells.

BACKGROUND OF THE INVENTION

Known in the art are methods for the determination of depth of water-seepage strata, comprising lifting the drill tool and lowering special flow meters (Driller's Handbook by V. I. Mischevich, vol. II, published 1973, "Nedra" Publishers, Moscow, p. 88 (in Russian)).

These methods are dificient in a low sensitivity of flow meters which cannot detect a stratum at low quantities of fluids entering the mud.

Known in the art is a method for the determination of depth of a water-seepage stratum, comprising a short-time suspension of drilling mud supply with subsequent restoration of circulation and detection at the surface of the batch of the drilling mud diluted with fluid from the change in density of the drilling mud compared to the original density, and measuring the time since the beginning of pumping till the appearance at the surface of the batch of drilling mud diluted with fluid (Bull. "Discoveries, Inventions Industrial Designs and Trademarks" USSR Inventor's Certificate No. 484301 Published in No. 34 of 1975, IPC E 21 b, 47 04).

This prior art method is also characterized by low accuracy with small differences in densities of the drilling mud and stratum fluid so that the application of this method is rather limited.

DISCLOSURE OF THE INVENTION

The invention resides in the provision of a method for the determination of depth of a stratum saturated with a fluid, such as water, oil or gas, and the type of fluid saturating the stratum, which enables the detection of location of a fluid-saturated stratum and type of the fluid in a short time and at high accuracy.

The invention materially resides in that in a method for the determination of depth of a fluid-saturated stratum and type of fluid, preferably mineralized water, oil and gas released during drilling, comprising suspending the supply of a drilling mud to a well upon revealing some fluid in the drilling mud leaving the well and restoring the supply of the drilling mud to the well after a certain time lapse, marking the time of restoration of drilling mud supply and the time of appearance at the surface of the batch of the drilling mud diluted with the fluid saturating the stratum to be used for the determination of depth of the stratum, according to the invention, the drilling mud fed to the well is pretreated in such a manner as to maintain the original value of its redox potential at a stable level, the value of redox potential of the drilling mud leaving the well is continuously measured and compared to the original value of redox potential of the drilling mud, and upon a change in the value of redox potential indicating to the presence of a stratum-saturating fluid in the drilling mud the supply of drilling mud to the well is suspended, whereafter the redox potential of a batch of drilling mud saturated with fluid is determined and compared to known normal values of redox potential to determine the type of the fluid.

The stable level of the value of redox potential is preferably maintained within the range from −1.6 to +1.8 V.

The method according to the invention enables the determination of depth of a stratum saturated with some fluid and fluid type: oil, gas or mineralized water with high accuracy. There is no need to use special geophysical instruments lowered into the well which would require considerable time waste.

BRIEF DESCRIPTION OF THE DRAWING

The method according to the invention will low be described in detail with reference to the accompanying drawing, in which:

FIG. 1 shows a principle diagram of an embodiment of a method for the determination of depth of a fluid-saturated stratum and fluid type.

BEST MODE FOR CARRYING OUT THE INVENTION

In drilling a well different rocks are drilled, including strata bearing some fluid. The fluid saturating a stratum means herein oil, gas or mineralized water. These fluids get in the circulating drilling mud and may be determined at the surface visually (from oil films, changes in colour, density, viscosity and the like).

Drilling mud is a complex heterophase polydisperse system in which reduction or oxidation of various substances occur when the mud is out of the equilibrium state. The measure of intensity of oxidation-reduction processes occurring in a heterophase system is the redox potential.

The studies made by the inventors showed that when mineralized stratum water, oil or gas is added to drilling mud the redox potential of the drilling mud materially changes either in the reduction or oxidation direction depending on the type of fluid added. When oil is added to the equilibrium drilling mud the redox potential usually changes in the reduction direction; when mineralized stratum water is added the redox potential changes in the oxidation direction; when a hydrogen sulphide containing gas is added the redox potential changes in the oxidation direction. Therefore, in case a drilling mud having a known value of redox potential is fed to the extracase space of the well, and the circulation is stopped, fluid from an oil-, gas- or water-seepage stratum is added to the drilling mud so that the batch of the drilling mud which is at the level of a fluid-seepage stratum is diluted with the fluid, and the redox potential of this batch changes in one or other direction. With the known influence of this or other fluid on the value of redox potential of drilling mud of a given type and also the well depth and rate of circulation of flow of the drilling mud leaving the well the location of the fluid-seepage stratum and type of the fluid can be determined.

For a better understanding of the method the reference is now made to FIG. 1.

For the determination of depth of a fluid-saturated stratum and fluid type, a stabilized drilling mud, that is a drilling mud with a redox value from −1.6 to 1.8 V is prepared. These values of the redox potential were found by way of experiments and characterize the redox potential which does not cause irreversible chemical reactions. In case the redox potential value of −1.6

V is exceeded coagulation of drilling mud occurs with further growth of reduction potential, and in case the value +1.8 V is exceeded the growth of oxidation potential takes place which results in degrading of drilling mud.

Redox potential of drilling mud is measured by means of a sensor 1 of any type, e.g. a calomel-type sensor. The sensor readings are recorded by an instrument 2.

The prepared drilling mud is fed by means of a pump 3 to a well 4. A sensor 5 coupled to a recorder 6 continuously measures redox potential of the drilling mud leaving the well and compares it to the original value of redox potential. A change in the value of redox potential testifies to the presence in the drilling und of a fluid saturating the stratum. Upon a change in the redox potential the circulation of the drilling mud in the well 4 is suspended for a time required for ion-exchange processes between the drilling mud and the fluid saturating the stratum to occur. During experimental studies the inventors have found that the time sufficient for completion of ion-exchange reactions ranges from 1 to 300 s.

For a time shorter than 1 s drilling mud has no time to come in contact with the stratum bearing a fluid. For a time exceeding 300 s irreversible phenomenon may occur in drilling mud as a result of long-term ion-exchange processes which may cause complete degradation of the drilling mud.

Since the moment of suspension of circulation of the drilling mud fluid starts getting to the batch of the drilling mud which is at the level of the stratum saturated with the fluid, and this fluid reacts with the drilling mud to result in the occurrence of electrochemical reactions changing the redox potential of this batch of the drilling mud.

Upon a lapse of time needed for the ion-exchange processes to occur, the circulation of the drilling mud in the well 4 is renewed, the time when the circulation was restarted is marked, the time of the beginning of appearance of the batch of the drilling mud diluted with the fluid is marked, and the time of appearance of the end of this batch of the drilling mud is marked. The time of the beginning and end of the batch of the drilling mud is marked by an abrupt change in the redox potential of the drilling mud.

The value of redox potential of the batch of the drilling mud saturated with the fluid is compared to known values of redox potential characterizing this or other fluid to determine the type of fluid (oil, gas or mineralized water) saturating the stratum.

For the determination of depth of the fluid saturated stratum the following formulae are used:

$$H_1 = \frac{Q - \Delta Q_1}{F_k} t_1 \quad (1)$$

$$H_2 = \frac{Q - \Delta Q_2}{F_k} t_2 \quad (2)$$

wherein $H_1$, $H_2$ are the depths of roof and bottom of stratum saturated with fluid, respectively, m;

Q is the pump capacity, cu.m/hr;

$\Delta Q_1$, $\Delta Q_2$ are differences in flow rates of the drilling mud at the inlet and outlet of the well till the time amounts $t_1$ and $t_2$, respectively, cu.m/hr;

$t_1$ is the time since the beginning of pumping till the beginning of appearance of the batch of the drilling mud saturated with fluid, s;

$t_2$ is the time since the beginning of pumping till the end appearance of the batch of the drilling mud saturated with fluid, s;

$F_k$ is the area of the annular space, sq.m.

Flow meters for measuring the flow rate of the drilling mud are not shown in the drawing.

INDUSTRIAL APPLICABILITY

The use of the invention enables the reduction of time needed to determine the depth of a stratum saturated with a fluid and fluid type. The invention also enables the reduction of cost owing to elimination of the application of special instruments.

We claim:

1. A method for the determination of depth of a fluid-saturated stratum and type of a fluid preferably such as mineralized water, oil and gas released during drilling, comprising suspending the supply of drilling mud to a well upon revealing a fluid in the drilling mud leaving the well and restoring the supply of the drilling mud to the well after a certain time lapse, marking the time of restoration of supply of the drilling mud to the well and the time of appearance at the surface of the batch of the drilling mud diluted with the fluid saturating the stratum to be used for the determination of depth of the stratum, characterized in that the drilling mud fed to the well is pretreated in such a manner as to maintain the original value of its redox potential at a stable level, the value of redox potential of the drilling mud leaving the well is continuously measured and compared to the original value of redox potential of the drilling mud, and upon a change in the redox potential of the drilling mud indicating to the presence of a fluid saturating the stratum in the drilling mud the supply of the drilling mud to the well is suspended, with subsequent measurement of redox potential of the batch of the drilling mud saturated with the fluid which is compared to known normal values of redox potential to determine the type of the fluid.

* * * * *